United States Patent [19]

Benson

[11] 4,102,607

[45] Jul. 25, 1978

[54] FLUID ENERGY TRANSLATING DEVICE

[75] Inventor: William Joseph Benson, Camarillo, Calif.

[73] Assignee: Abex Corporation, New York, N.Y.

[21] Appl. No.: 613,455

[22] Filed: Sep. 15, 1975

Related U.S. Application Data

[63] Continuation-in-part of Ser. No. 455,968, Mar. 29, 1974, abandoned.

[51] Int. Cl.[2] ..... F04B 1/30; F01B 13/06

[52] U.S. Cl. ..... 417/222; 91/506

[58] Field of Search ..... 417/218, 222, 292; 92/1

[56] References Cited

U.S. PATENT DOCUMENTS

| | | | |
|---|---|---|---|
| 2,716,946 | 9/1955 | Hardy | 417/292 |
| 2,768,585 | 10/1956 | Hardy | 417/292 |
| 3,250,227 | 5/1966 | Kouns | 417/222 |
| 3,637,327 | 1/1972 | Kubiak | 417/222 |
| 3,676,020 | 7/1972 | Andreasen | 417/222 |

*Primary Examiner*—William L. Freeh

*Attorney, Agent, or Firm*—Kinzer, Plyer, Dorn & McEachran

[57] ABSTRACT

A fluid energy translating device in which nul displacement is effected by a valve element operated by an abnormal temperature or an abnormal pressure.

6 Claims, 4 Drawing Figures

FIG. 1
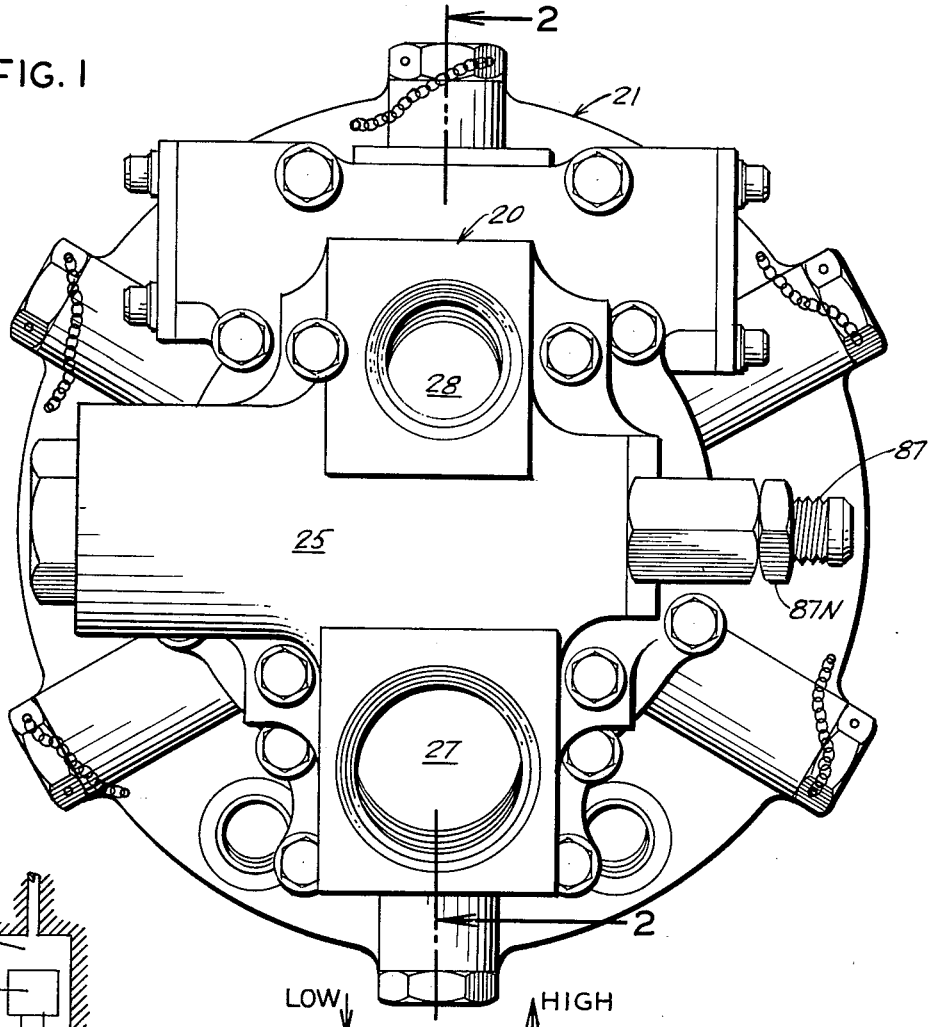
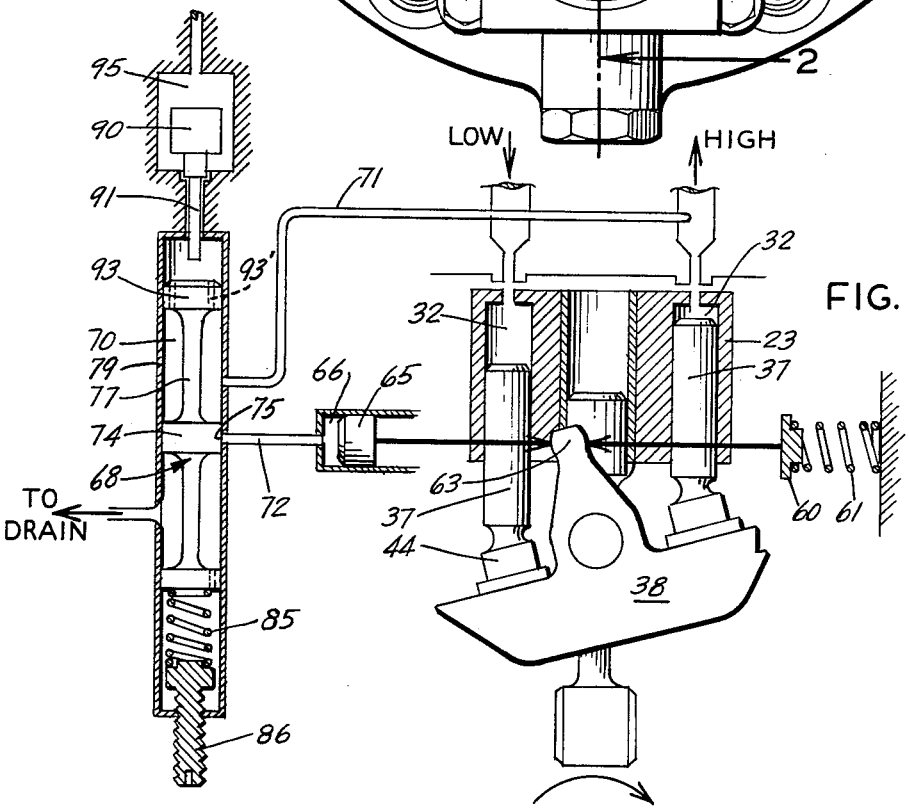
FIG. 4

FLUID ENERGY TRANSLATING DEVICE

This application is a continuation-in-part of application Ser. No. 455,786 filed Mar. 29, 1974 now abandoned.

This invention relates to a fluid translating device in the form of a hydraulic pump but which will constitute a hydraulic motor when operating in a reverse sense; the present disclosure is concerned with both forms.

Many hydraulic systems have a pump unit located in isolation loops so that in the event of a system or component failure the pump may be isolated by valves which stop fluid flow. Isolation of this character is relied upon, for example, in hydraulic systems servicing air flight controls.

When a pump is isolated from the standpoint of fluid flow its work energy, as it continues to operate, is dissipated by heating the isolated fluid confined within the pump chambers and passages. The result is an overheated pump which may exceed design limits, and in any event overheating contributes to a shortened life of critical pump parts.

In some instances the problem of overheating can be partly alleviated by opening a by-pass so the fluid pressurized by the pump is simply circulated through the pump. This approach, though feasible, has limited application because any prolonged remedy thus effected is bound to result in overheating as the pump continues to recycle fluid within itself.

The more effective remedy would be to completely neutralize the displacement of the pump, idling the pump so that no fluid is circulated upon the occurrence of an excessive temperature. This solution has indeed been recognized: see U.S. Pat. No. 2,768,585 where additionally an excessive flow rate, if sensed, is used to idle the pump.

It is also known to employ pressure compensation means to idle a pump in the event of excessive delivery pressure. For example, it is known to locate the cam plate of an axial piston pump in nul position to eliminate piston displacement in the event excessive pressure is detected, accomplished in effect by exerting pump outlet pressure on a positioning member attached to the cam plate. This known axial piston pump has proven to be eminently satisfactory in aircraft hydraulic flight control systems and in other systems as well, and one object of the present invention is to modify the pressure compensation means in the known pump to be responsive as well to an unacceptable temperature rise.

In the preferred embodiment of the present invention a valving piston is positioned to admit high pressure fluid to a fluid operated plunger bearing on an element of the cam plate to move the cam plate to nul position where pump displacement becomes zero; the valving piston is so positioned, against a spring bias, by the prevalence of excessive pressure or, independently, upon expansion of a thermal element responding to excessive temperature in the fluid being displaced. A more specific object of the invention is to incorporate as much of the compensating structure as possible in what is known as the port cap of the pump since this makes possible virtually instantaneous response to the temperature condition.

More generally it is an object of the present invention to locate the displacement control member of a variable delivery pump (or motor) in nul position by a force derived from the high pressure port. This force is applied to the control member by a plunger, driven in turn by the high pressure fluid which is normally withheld but which is released to operate the plunger when a valve is shifted to an open position either by high pressure fluid or by the expansible element of a thermally responsive member itself immersed in the fluid being translated.

Other and further objects of the present invention will be apparent from the following description and claims and are illustrated in the accompanying drawings which, by way of illustration, show a preferred embodiment of the present invention and the principle thereof and what is now considered to be the best mode contemplated in applying that principle. Other embodiments of the invention embodying the same or equivalent principle may be used and structural changes may be made as desired by those skilled in the art without departing from the present invention.

In the drawing:

FIG. 1 is an end elevation of a pump constructed in accordance with the present invention;

FIG. 4 is a detail view, partly schematic, of means for controlling the position of the cam plate of the pump.

The present invention in its preferred embodiment is applied to a fluid pressure energy translating device in the form of a variable delivery axial piston pump the operation of which conforms generally to the similar pump disclosed in U.S. Pat. No. 2,835,228. This pump has an established reputation for reliable performance in aircraft hydraulic systems having especially severe service requirements. The device could be operated as well in the reverse sense, serving as a hydraulic motor.

Figure 2:
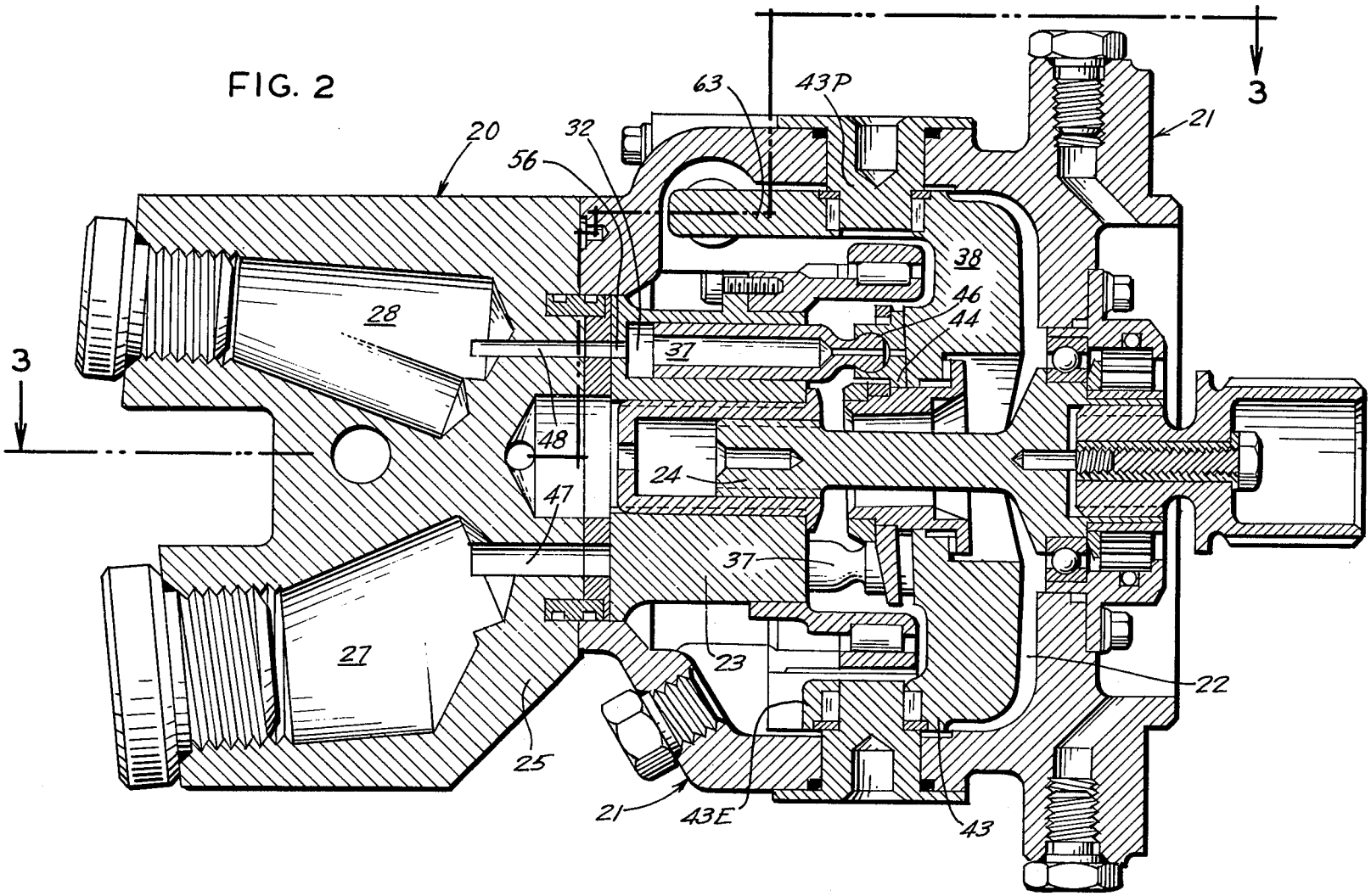
FIG. 2 is a sectional view on the line 2—2 of FIG. 1.

The pump 20 includes an outer housing 21, FIG. 2, which affords an enlarged chamber 22 in which a cylinder barrel 23 is disposed for rotation. The cylinder barrel contains the expansible chamber for translating fluid between low and high pressure limits as will be explained. The barrel is rotated within the housing or casing by a gear driven shaft 24 splined to the cylinder barrel.

The cylinder barrel has one end in flush slidable engagement with the opposed face of a port cap 25 fastened to the housing 21. The port cap has large openings 27 and 28 constituting inlet (low pressure) and outlet (high pressure) passages to which conduits may be joined for conveying fluid to and from the pump, respectively.

To define and afford the expansible chamber, the cylinder barrel is formed with individual piston chambers or cylinders 32, and a piston member 37 is disposed in each cylinder for reciprocation therein. Each piston is a working member effective to translate low pressure inlet fluid supplied to the inlet 27 into high pressure fluid delivered to the outlet 28 for further transmittal to the hydraulic system being serviced. Both the supply fluid and delivery fluid have characteristic pressure and temperature conditions identified with normal operation. For example, a normal pressure may be 1500 psi, up to 3000 psi. An abnormally high and unacceptable pressure is 3500 psi and/or a fluid temperature of 200° C.

To determine and vary the displacement, a displacement control member in the form of a cam plate 38 is mounted within the casing 21 to be disposed at an angle relative to the axis of the cylinder barrel. This angle of the control member, not shown in FIG. 2, determines the displacement of the pistons as explained in the patent. The cam plate 38 is carried by a hanger 43 which has end members as 43E pivotally mounted on trunnion pins 43P. The trunnion pins are mounted in the sides of the housing 21, and from this it will be seen that the cam plate may be tilted about the axes of the trunnion pins to account for piston displacement.

In order to translate fluid, the pistons 37 are constrained to follow the cam plate 38 by means including bearing shoes 44 which have sliding contact with the cam plate 38. The end of each piston adjacent the cam plate is provided with a ball 46 mounted in a socket of the related shoe 44 thereby accounting for articulate, reciprocation of the pistons as the cylinder barrel is rotated. The center of each ball 46 is spaced equally from the face of the cam plate on which the shoes 44 slide so each shoe is reciprocated equidistantly as the cylinder barrel is rotated; consequently the expansible chambers 32 are repeatedly expanded and contracted, respectively, to accept low pressure fluid and then pressurize it.

The port cap 25 has arcuate, mutually exclusive ports 47 and 48 constituting, respectively, low pressure and high pressure ports communicating with the inlet 27 and outlet 28 respectively. In plan view the ports 47 and 48 are arcuate, FIG. 2.

The pumping sections (left ends) of the cylinders 32 have openings 56 communicating alternately, during rotation of the cylinder barrel, with the inlet and outlet ports 47 and 48 in the port cap 25 as explained in the patent. When a cylinder communicates with the inlet port 47, the piston is being retracted to expand the cylinder to permit fluid to pass from the inlet 47 through a port as 56 to the interior of the cylinder. When an opening 56 of a cylinder communicates with the outlet passage 48, the related piston is in its contracting movement to discharge fluid under pressure to the outlet port 48. Thus as a piston is compelled by the tilted cam plate to move away from a cylinder port 56, the port is valved to the inlet system 27–47 to allow fluid to displace into the expanding cylinder chamber; whereas the valving and timing is such that as a piston is forced in the opposite direction, fluid under pressure is translated through the port 56 to the outlet or discharge system 28–48.

It has been mentioned above the cam plate is shown in its nul position in FIG. 2. In this position, however, the cam plate is slightly tilted at a 3° angle in the commercial structure and this is so in order to compensate for inherent leakage, which is to say some movement of the pumping pistons must be continued to prevent any unacceptable decline in pressure. The cam plate in its full displacement position is shown in FIG. 4, partly schematic. To locate the cam plate normally in its piston stroking or displacement position, a plunger 60 biased by a spring 61 forcefully engages a cam plate positioning element 63 which may be merely an extension of the cam plate. To shift the cam plate to the nul, essentially non-stroking position, another plunger 65, FIGS. 3 and 4, applies an opposed force to the positioning element, opposing spring 61. The opposing force exerted by plunger 65 is derived from the high pressure fluid, applied to the plunger 65 when an excessive pressure mode is sensed or when an excessive temperature mode is sensed. The manner in which these two independent modes of destroking the cam plate are established through a common valve will now be explained.

Figure 3:
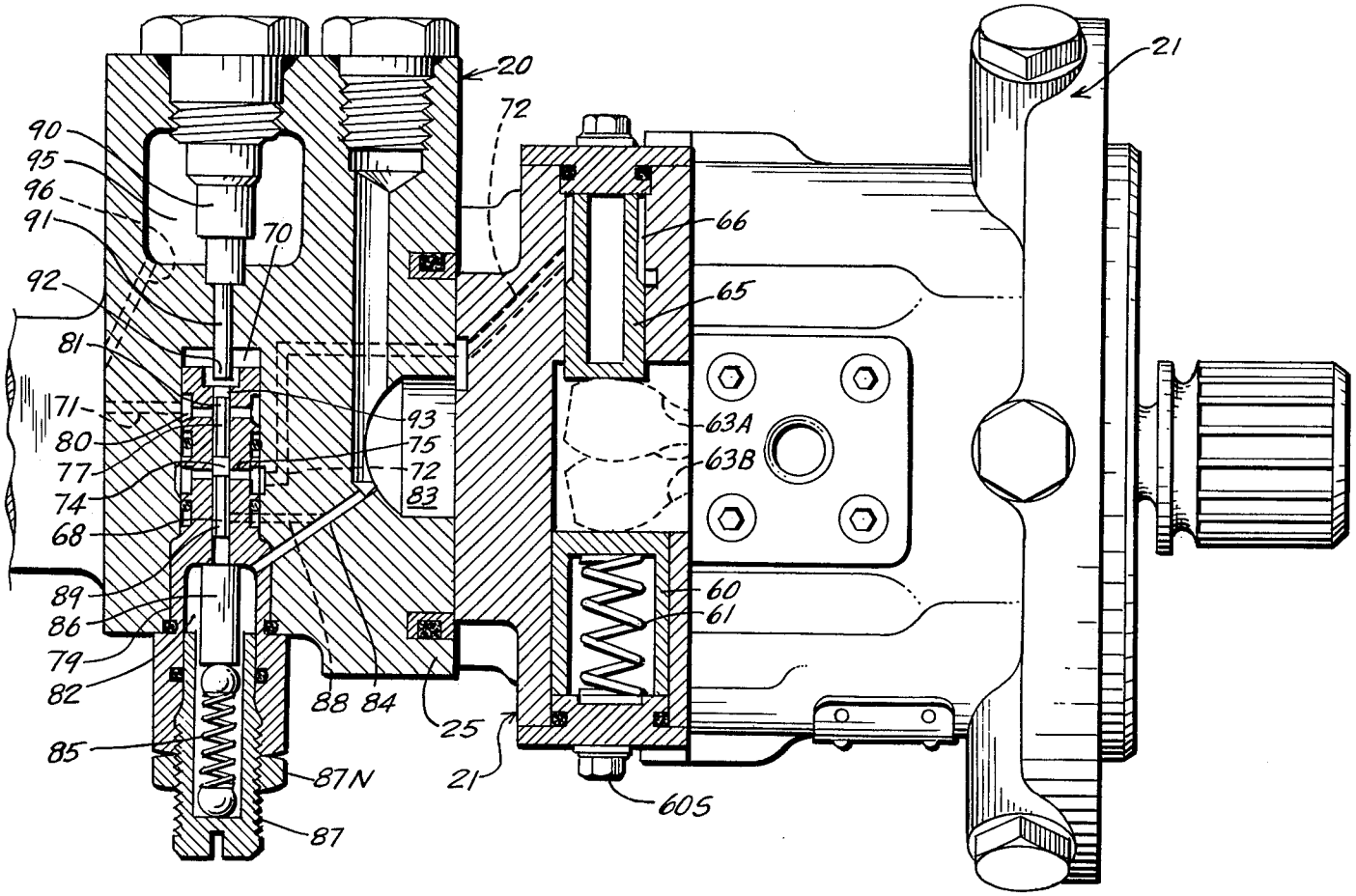
FIG. 3 is a sectional view on the line 3—3 of FIG. 2.

The two extreme positions of the cam plate are identified in FIG. 3 as positions 63A and 63B of the positioning element 63. In position 63A, the cam plate is in its full stroking position, located by the spring biased plunger 60 as fully extended; plunger 65 is fully retracted at the time. In position 63B, the cam plate is located in its nul position by plunger 65 fully extended by high pressure (pump discharge) fluid admitted to a chamber 66 confining plunger 65 in the pump housing; plunger 60, on the other hand, has been pushed to its fully retracted position.

To operate plunger 65, fluid under pressure is admitted to chamber 66 but is normally withheld therefrom by a valve 68 disposed in a chamber 70 which communicates with the discharge port of the pump by way of a passage 71. A passage 72, formed partly in the port cap and partly in the housing 21, extends from chamber 70 to chamber 66. This passage is normally closed by valve 68 but when valve 68 is moved to its open position high pressure fluid is communicated to chamber 66, extending plunger 65 to shift the cam plate to its nul position.

Valve 68 is a piston valve of the spool type having an intermediate valving land 74 which normally closes a port 75 adapted to communicate passage 72 with a reduced section 77 of the valving piston whereby fluid contained in chamber 70 may be transmitted to chamber 66.

Valve 68 is confined for movement in a housing member 79 which presents the port 75. The valve housing 79 is provided with another port 80 which communicates with the bore 81 surrounding the reduced portion 77 of the valve 68, port 80 in turn communicating with chamber 70 so that high pressure fluid admitted to chamber 70 through passage 71 is also communicated to the bore or reduced portion 77 of valve 68 within valve housing 79. Leakage past valve 68 collects in a chamber 82 and is returned to the so-called case drain 83 through a passage 84. In FIG. 4, port 80 communicating with chamber 70 is represented by drain openings 93' in the head of the piston valve hereinafter identified.

The valve 68 is held in a normally closed position where land 74 in effect closes port 75 and such normal position of the valve 68 is determined by a spring 85 which engages forcefully an enlarged extension 86 at one end of the valve 68, the extension 86 being located in chamber 82 which collects leakage. Thus the spring 85 exerts a bias on valve 68 resisting the tendency of fluid pressure on land 74 to move valve 68 to its open position. The degree of bias, that is, the counterforce resisting the tendency of the valve to be opened may be regulated by a screw 87 which cooperates with end 86 of the valve to capture the spring, the position of the screw being fixed by a lock nut 87N.

Thus the spring 85 may be slackened or tightened to reduce or enlarge the bias force applied to valve 68. When the pressure of fluid exerted on the valve land 74 of the piston exceeds the pre-set bias force of spring 85, valve 68 is shifted to the open position, compressing spring 85. The valve land 74 moves past port 75, downward as viewed in FIG. 3, and high pressure fluid travels from chamber 81 which surrounds the reduced portion 77 of the valve 68 and enters port 75, moving through passage 72 into chamber 66 to drive plunger 65 against the cam plate positioning element 63 located in position 63A, FIG. 3. When normal operating pressure is re-established, the force of spring 85 becomes the larger force on the piston valve 68 and the latter is restored by spring 85 to its normal position closing port 75. Fluid bleeds from chamber 66 to case drain 83 through a passage 88 communicating with valve bore 89. Spring-biased plunger 60 restores the cam plate to normal position.

To operate valve 68 in the other mode, the temperature responsive mode, a thermal member 90 is provided with an extendible piston element 91 having a free end 92 disposed immediately adjacent a head land 93 at the end of piston 68 opposite spring 85. To expose the thermal member 90 to the fluid being translated, provision is made for a passage 96 in the port cap extended from the inlet (suction) port 27 to communicate with chamber 95 and another passage (not shown) returns fluid to the low pressure port 47 so that fluid may constantly circulate into and out of chamber 95.

The thermal element 90 is commercially available. The interior contains a thermally responsive plastic material which, on sufficient expansion, extends element 91 to shift valve 68. Other thermal members could be used as well so long as an extendible element thereof is in position to drive the valve member as by applying a shifting force to the head 93 of valve 68. When the fluid to be translated has cooled sufficiently, or when the condition giving rise to an abnormal temperature has been removed, piston 91 retracts and spring 85 expands to restore valve 68 to its normal position closing port 75. The thermal element could also be immersed in the high pressure fluid as explained hereinafter.

The valving structure 68 shown in FIG. 3 is generally known and has been used to destroke the pump 20 under the excess pressure mode of operation. It is new, however, to operate the valve 68 independently under a temperature responsive mode and especially to bleed into chamber 95, from chamber 70, the high pressure fluid for temperature sensing, as shown in FIG. 4 where the bleed passage is identified schematically by the drain openings 93' and a loose fit of element 91 within a bore in the port cap. In actual practice the drain openings 93' may be a similar loose fit of head 93 in chamber 70, which can be readily envisioned from FIG. 3.

I claim:

1. In a fluid energy translating device having an expansible chamber for translating fluid under pressure between low and high pressure ports, and in which displacement of the chamber is determined by a control member having a nul position for essentially non-displacement and a second position establishing displacement, means to locate the control member in nul position upon occurrence of excessive pressure or excessive temperature of fluid being translated and comprising:

(a) a plunger engaging said control member and operated by fluid under pressure to dispose said control member in nul position;

(b) a valve chamber for receiving high pressure fluid translated by said device and a control passage leading therefrom for directing high pressure fluid to the plunger;

(c) a valve in said chamber for closing and disclosing said passage;

(d) means applying a bias to said valve normally to locate the valve in closing position in opposition to fluid pressure tending to locate the valve in opening position;

(e) a thermal element positioned in a temperature sensing chamber to sense an excessively high operating temperature of fluid being translated and having an extendable portion in alignment with and directly engageable with said valve in opposition to said valve bias means; and (f) passage means for delivering fluid being translated into and out of said temperature sensing chamber.

2. A device according to claim 1 in which fluid from the low pressure port is delivered to the temperature sensing chamber, second extendible portion being a piston.

3. A device according to claim 1 in which high pressure fluid is bled from the valve chamber to the temperature sensing chamber, said extendible portion being a piston.

4. A device according to claim 1 in the form of an axial piston pump having a rotatable cylinder barrel supporting a plurality of pistons; said control member being a cam plate; a separable port cap fastened to said housing and affording the low and high pressure ports; said thermal element, said chamber containing the valve means and said temperature sensing chamber being located coaxially in the port cap; said control passage including a portion in the port cap and a portion in said housing; and said plunger being confined in said housing.

5. A device according to claim 4 in which fluid from the low pressure port is delivered to the temperature sensing chamber through a passage in the port cap.

6. A device according to claim 4 in which high pressure fluid is bled from the valve chamber to the temperature sensing chamber.

* * * * *

UNITED STATES PATENT AND TRADEMARK OFFICE

CERTIFICATE OF CORRECTION

PATENT NO. : 4102607

DATED : July 25, 1978

INVENTOR(S) : William Joseph Benson

It is certified that error appears in the above-identified patent and that said Letters Patent are hereby corrected as shown below:

Col. 1, line 4, change "455786" to --455968--.

Col. 1, line 40, change "eliminate" to --reduce--.

Col. 1, line 54, change "where pump displacement becomes zero" and insert --(essentially non-stroking position)--.

Col. 6, line26, change "second" to --said--.

Signed and Sealed this

*Fifteenth* Day of *May 1979*

[SEAL]

*Attest:*

RUTH C. MASON
*Attesting Officer*

DONALD W. BANNER
*Commissioner of Patents and Trademarks*